US006683445B2

(12) United States Patent
Park

(10) Patent No.: US 6,683,445 B2
(45) Date of Patent: Jan. 27, 2004

(54) INTERNAL POWER VOLTAGE GENERATOR

(75) Inventor: Kee Teok Park, Kyoungki-do (JP)

(73) Assignee: Hynix Semiconductor Inc., Ichon-shi (KR)

( * ) Notice: Subject to any disclaimer, the term of this patent is extended or adjusted under 35 U.S.C. 154(b) by 23 days.

(21) Appl. No.: 10/094,639

(22) Filed: Mar. 12, 2002

(65) Prior Publication Data

US 2003/0001554 A1 Jan. 2, 2003

(30) Foreign Application Priority Data

Jun. 29, 2001 (KR) ..... 2001-38020

(51) Int. Cl.[7] ..... G05F 3/16; G05F 1/10

(52) U.S. Cl. ..... 323/315; 323/313; 327/530

(58) Field of Search ..... 323/315, 313, 323/314, 312, 311; 307/296.1, 296.4, 296.6, 296.8, 475, 260; 327/530, 534, 538

(56) References Cited

U.S. PATENT DOCUMENTS 4,978,905 A * 12/1990 Hoff et al. ..... 323/314
4,994,688 A * 2/1991 Horiguchi et al. ..... 307/296.8
5,254,880 A 10/1993 Horiguchi et al.
5,371,705 A 12/1994 Nakayama et al.
5,396,113 A 3/1995 Park et al.
5,526,313 A 6/1996 Etoh et al.
5,557,571 A 9/1996 Kato
5,686,825 A * 11/1997 Suh et al. ..... 323/316
5,862,096 A 1/1999 Yasuda et al.
5,892,386 A 4/1999 Lee et al.
5,910,911 A 6/1999 Sekiguchi et al.
5,991,191 A 11/1999 Rao
5,995,435 A 11/1999 Hamamoto et al.
6,041,011 A 3/2000 Umczawa et al.
6,046,954 A 4/2000 Yoon et al.
6,052,313 A 4/2000 Atsumi et al.

* cited by examiner

*Primary Examiner*—Rajnikant B. Patel
(74) *Attorney, Agent, or Firm*—Jacobson Holman PLLC

(57) ABSTRACT

An internal power voltage generator for achieving stable operation of a semiconductor device by selectively connecting an external power voltage terminal to a supply line of an internal power voltage in an operation power potential range of the semiconductor device, and generating a predetermined reference voltage in a reference voltage generator in accordance with the internal power voltage after a predetermined potential.

9 Claims, 9 Drawing Sheets

INTERNAL POWER VOLTAGE GENERATOR

FIELD OF THE INVENTION

The present invention generally relates to an internal power voltage generator, and more specifically, to an internal power voltage generator of a current mirror type which converts an external power voltage into an internal power voltage by using a reference voltage. The internal power voltage generator generates a predetermined reference voltage by making use of an external power voltage during a specific power potential period, but generates the predetermined reference voltage by making use of the internal power voltage after the specific power potential period.

BACKGROUND OF THE INVENTION

Semiconductor integrated circuits need to be operable with lower power consumption and to be hardly affected from external noises, accompanying with enhancement of reliability and stable operations thereof.

In view of the above basic requirements, in order to drive internal circuits at stable operation states, it is customary to use an internal power voltage made in the semiconductor integrated circuits rather than an external power voltage dependent on external circumstances.

There are various ways for generating a stable internal power voltage. FIG. 1 illustrates a conventional voltage down converter of a current mirror type in which an external power voltage VEXT is converted into a conventional internal power voltage QVint by using a reference voltage.

The conventional voltage down converter usually comprises a differential amplifier. The first reference circuit 1 receives the external power voltage VEXT and generates the first reference voltage Vr1. The first reference voltage Vr1 is potential-amplified by the second reference circuit 2. The second reference circuit 2 generates the second reference voltage Vr2.

A stress voltage circuit 3 loads a stress voltage on the second reference voltage Vr2. An internal power driver 4 generates the internal power voltage QVint with reference to output an voltage from the stress voltage circuit 3. The internal power voltage QVint is provided to an internal circuit 5.

However, since the first reference circuit 1 of the conventional voltage down converter utilizes only the external power voltage VEXT as a power source, the first reference voltage Vr1 may change when the external power voltage VEXT fluctuates due to external environments.

In other words, in the conventional voltage down converter, the external power voltage VEXT applied to the first reference circuit 1 may be easily variable in accordance with external temperature changes or noises. Accordingly, in special cases, the external power voltage VEXT of sufficient potential may be transferred to the current mirror loop in the voltage down converter. As a result, it would be difficult to obtain a reliable value of the first reference voltage Vr1.

SUMMARY OF THE INVENTION

It is, therefore, an object of the present invention to overcome the above problems encountered in the prior art and to achieve stable operation of a semiconductor device by selectively utilizing external or internal power voltages in accordance with an operation power potential period of the semiconductor device.

According to an aspect of the present invention, there is provided an internal power voltage generating unit including: a switch control means for connecting an external power voltage terminal to a internal power voltage supply line in an operation power potential range, and for cutting off the connection between the external power voltage terminal and the internal power voltage supply line if the external power voltage reaches a predetermined potential level; a first reference circuit for generating a predetermined first reference voltage by making the use of the internal power voltage; a second reference circuit for generating a second reference voltage by amplifying the first reference voltage supplied from the first reference circuit; and an internal power driver for generating the internal power voltage with the second reference voltage supplied from the second reference circuit, and for driving internal circuits with the internal power voltage.

The foregoing features and advantages of the invention will be more fully described in the accompanying drawings.

BRIEF DESCRIPTION OF THE DRAWINGS

The above and other objects, features and advantages of the present invention will become more apparent from the following detailed description when taken in conjunction with the accompanying drawings in which.

DESCRIPTION OF THE PREFERRED EMBODIMENT

It should be understood that the description of the preferred embodiment is merely illustrative and that it should not be taken in a limiting sense.

Figure 1:
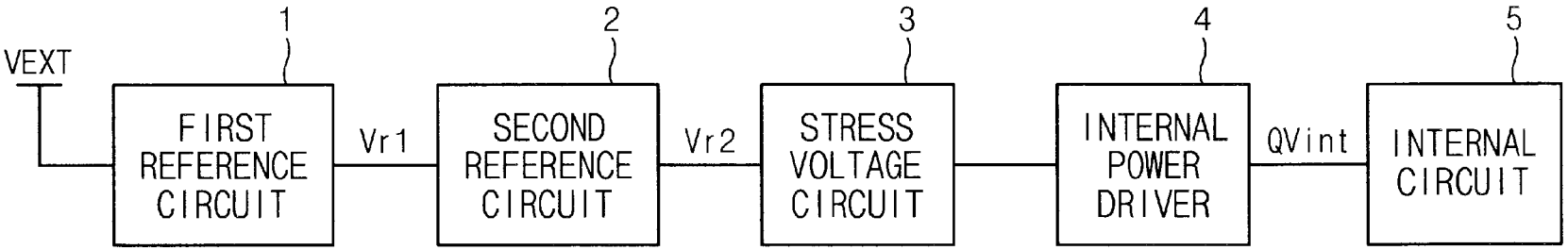
Fig.1(Prior Art)
FIG. 1 is a block diagram of a conventional internal power voltage generator according to the conventional art.
Figure 2:
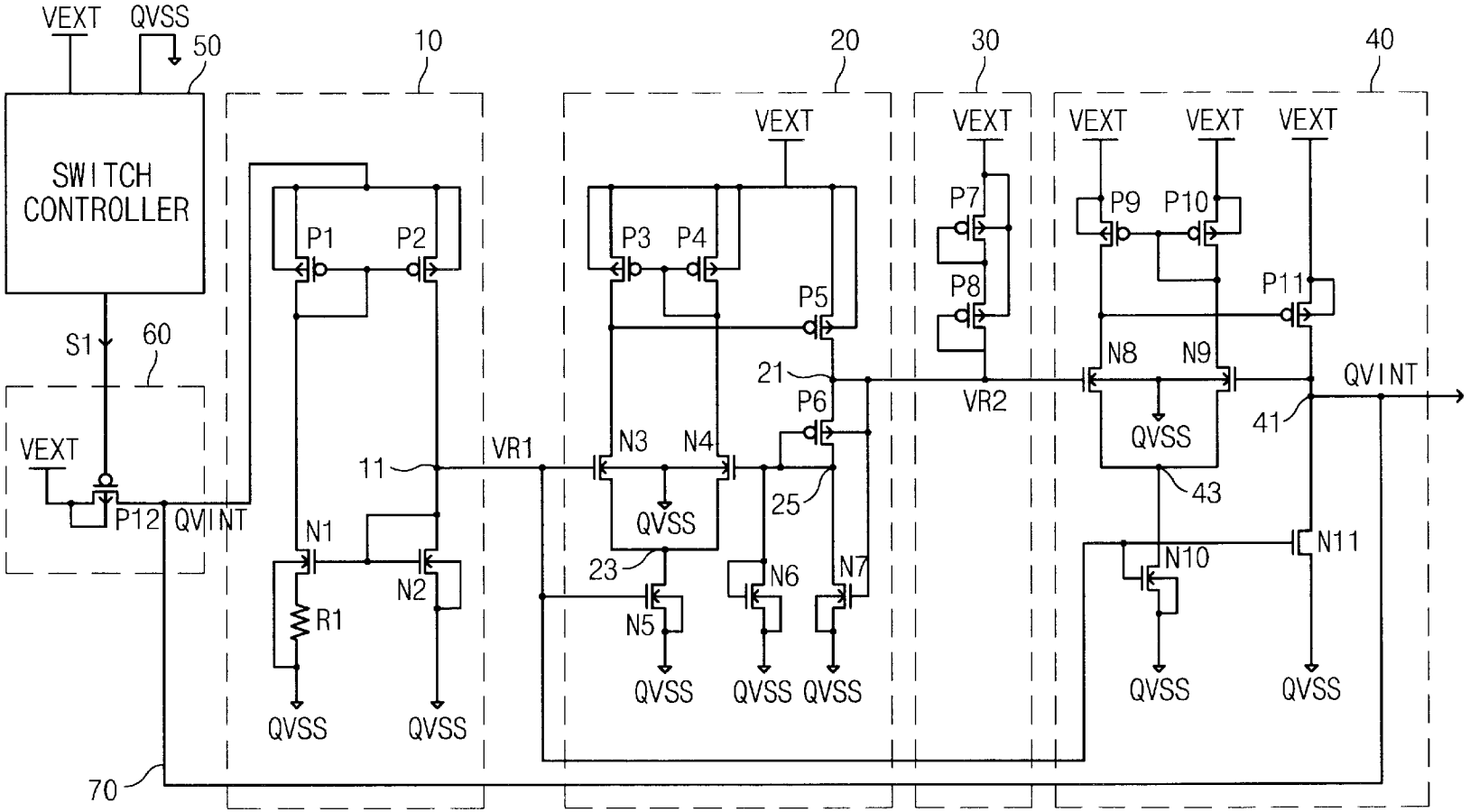
FIG. 2 is a circuit diagram showing an internal power voltage generator according to a preferred embodiment of the present invention.

FIG. 2 is a circuit diagram showing an internal power voltage generator according to an embodiment of the present invention.

Referring to FIG. 2, the internal power voltage generator includes a switch controller 50, a switch circuit 60, the first reference circuit 10, the second reference circuit 20, a stress voltage circuit 30, and voltage driver 40. The switch circuit 60 selectively connects the external power voltage terminal VEXT with the internal power voltage QVINT supply line 70 of under the control of the switch controller 50.

The first reference circuit 10 selectively receives the external power voltage VEXT or the internal power voltage QVINT from an internal power driver 40, and then generates the first reference voltage VR1 of a constant voltage level.

The second reference circuit 20 potential-amplifies the first reference voltage VR1 and generates a second reference voltage VR2. The stress voltage circuit 30 loads a stress voltage on the second reference voltage VR2. The internal power driver 40 generates the internal power voltage QVINT by making use of the output voltage from the stress voltage circuit 30 as a reference voltage.

According to the aforementioned discussion of FIG. 2, the first reference circuit 10 generates the first reference voltage from the internal power voltage QVINT having a changing range lower than that of the external power voltage VEXT when an initial drive voltage has a larger potential, than a predetermined potential, thereby minimizing variation of the first reference voltage VR1.

A detailed discussion of the above elements is herein explained with reference to FIG. 2.

The reference circuit 10 includes PMOS (P-channel metal-oxide-semiconductor) transistors P1 and P2 having a common source node connected to the internal power voltage QVINT supply line 70. Gates of the PMOS transistors P1 and P2 are commonly connected a drain node of the PMOS transistor P1. An NMOS (N-channel MOS) transistor N1, connected between the PMOS transistor P1 and a resistor R1, is connected to a ground voltage terminal QVSS through its bulk region. An NMOS transistor N2 is connected between an output terminal 11 (that is a drain node of the PMOS transistor P2) and the ground voltage terminal QVSS. The drain node of the NMOS transistor N2 is connected to its gate node, which is connected together with a gate of the NMOS transistor N1. The bulk region of the NMOS transistor is connected to the ground voltage terminal QVSS. The first reference voltage VR1 is generated at the output terminal 11.

The second reference circuit 20 includes PMOS transistors P3~P6 and NMOS transistors N3~N7. The PMOS and NMOS transistors, P3~P4 and N3~N5, form a differential amplifier. Sources of the PMOS transistors P3~P5 are connected to the external power voltage VEXT, together with their bulk regions. Gates of the PMOS transistors P3 and P4 are in common coupled to a drain node of the PMOS transistor P4. A gate of the PMOS transistor P5, which is connected between the external power voltage VEXT and an output terminal 21, is coupled to a drain node of the PMOS transistor P3. The output terminal 21 is connected to the ground voltage terminal QVSS through the PMOS and NMOS transistors P6 and N7. The bulk region of the PMOS transistor P6 and a gate of the NMOS transistor N7 are in common coupled to the output terminal 21. The gate of the PMOS transistor P6 is in common coupled to a node 25 between the PMOS and NMOS transistors P6 and N7. The NMOS transistor N3 is connected between the PMOS transistor P3 and a node 23, and the NMOS transistor N4 is connected between the PMOS transistor P4 and the node 23. Gates of the NMOS transistors N3 and N4 are coupled to the output terminal 11 of the first reference circuit 10 and the node 25, respectively. Bulk regions of the NMOS transistors N3 and N4 are connected to the ground voltage terminal QVSS. Between the node 23 and the ground voltage terminal QVSS, the NMOS transistor N5 whose gate is coupled to the output terminal 11 of the first reference circuit 10 is connected. The NMOS transistor N6 is connected between the node 25 and the ground voltage terminal QVSS.

The stress voltage circuit 30 is comprised of PMOS transistors P7 and P8, which are connected between the external power voltage VEXT and the output node 21 of the second reference circuit 20. Each gate of the PMOS transistors P7 and P8 is coupled to its drain, and their bulk regions are in common coupled to the external power voltage VEXT.

The internal power driver 40 includes PMOS transistors P9~P11 and NMOS transistors N8~N11. The PMOS and NMOS transistors P9~P10 and N8~N10, forms a differential amplifier. Sources of the PMOS transistors P9~P10 are connected to the external power voltage VEXT, together with their bulk regions. Gates of the PMOS transistors P9 and P10 are coupled to a drain node of the PMOS transistor P10 in common. The gate of the PMOS transistor P11, connected between the external power voltage terminal VEXT and an output terminal 41 of the driver 40, is coupled to a common drain node of the PMOS and NMOS transistors, P9 and N8. The bulk region of the PMOS transistor P11 is coupled to the external power voltage terminal VEXT.

The NMOS transistor N8 is connected between the drain of the PMOS transistor P9 and a drain of the NMOS transistor N10. The NMOS transistor N9 whose gate is coupled to the output terminal 41 is connected between the PMOS transistor P10 and the drain of NMOS transistor N10. Gates of the NMOS transistors N8 and N9 are coupled to the output terminal 21 of the second reference circuit 20 and the output terminal 41, respectively. Bulk regions of the NMOS transistors N8 and N9 are connected to the ground voltage terminal QVSS. The bulk region of the NMOS transistor N10 is connected to the ground voltage terminal QVSS. The gate of the NMOS transistor N10 is coupled to the output terminal 11 of the first reference circuit 10, together with a gate of the NMOS transistor N11 which is connected between the output terminal 41 and the ground voltage terminal QVSS.

The switch circuit 60 operates to connect the external power voltage terminal VEXT to the internal power voltage QVINT supply line, in response to the switching control signal S1 from the switch controller 50. The switch circuit 60 serves to connect the external power voltage terminal VEXT to the supply line 70 of the internal power voltage QVINT in a specific potential range between the ground voltage QVSS and the external power voltage, for the purpose of ensuring that the first reference circuit 10 is not conductive until the external power voltage VEXT attains a predetermined level at an initial drive time.

The switch circuit 60 comprises a PMOS transistor P12 connected between the external power voltage terminal VEXT and the internal power voltage QVINT supply line 70. The switching control signal S1 supplied from the switch controller 50 is applied to a gate of the PMOS transistor P12.

The internal power voltage QVINT and the ground voltage QVSS may be global power source voltages used in a chip, or internal power source voltages partially used for driving internal circuits.

Figure 3:
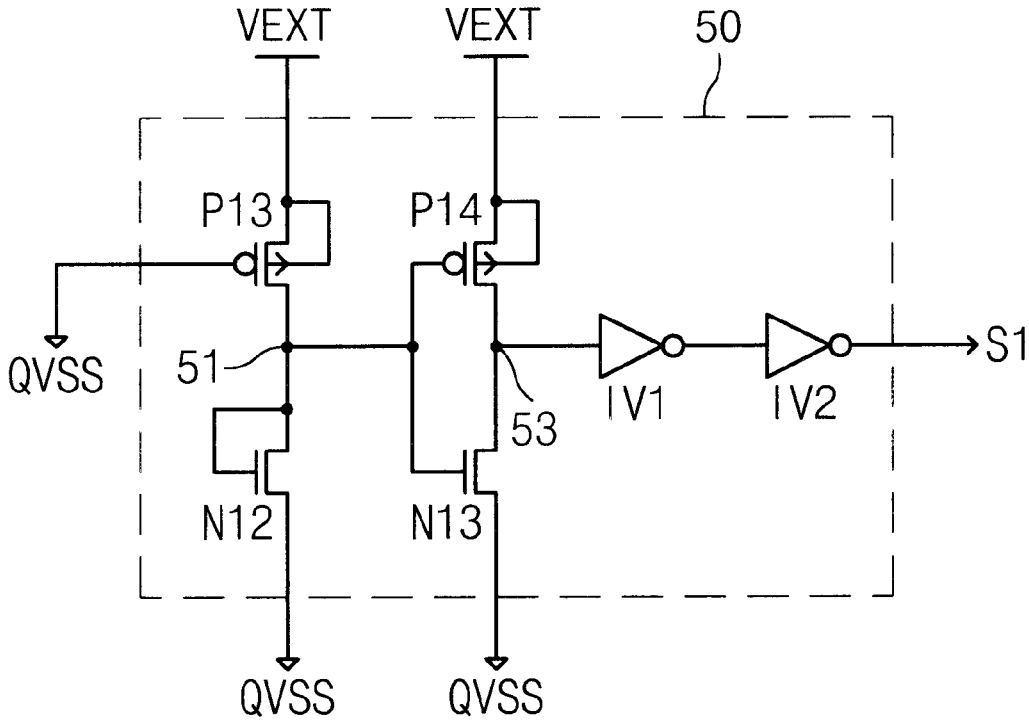
FIG. 3 is a circuit diagram showing a switch controller employed in the internal power voltage generator shown in FIG. 2.

The switch controller 50 controls the operation of the switch circuit 60, which is shown in FIG. 3.

The switch controller 50 includes PMOS transistors P13 and P14, NMOS transistors N12 and N13, and inverters IV1 and IV2. The PMOS and NMOS transistors P13 and N12, are connected in series between the external power voltage terminal VEXT and the ground voltage terminal QVSS. The gate of the PMOS transistor P13 is coupled to the ground voltage terminal. The bulk region of the PMOS transistor P13 is connected to the external power voltage terminal VEXT. The gate and drain of the NMOS transistor N12 are connected in common. The PMOS and NMOS transistors P14 and N13 are connected in series between the external power voltage terminal VEXT and the ground voltage terminal QVSS. The bulk region of the PMOS transistor P14 is connected to the external power voltage terminal VEXT. Gates of the PMOS and NMOS transistors P14 and N13 are coupled to a common drain node 51 between the PMOS and the NMOS transistors P13 and N12.

The inverters IV1 and IV2 are serially connected from a common drain node 53 between the PMOS and NMOS transistors P14 and N13. The inverters IV1 and IV2 delay an out signal from the common drain node 53 and output the delayed output signal (i.e., the switching control signal) S1 the switch circuit 60.

The switch controller 50 controls the switch circuit 60 which connects the external power voltage terminal VEXT to the internal power voltage QVINT supply line 70 at a specific potential range between the ground voltage QVSS and the external power voltage VEXT.

The operation of the switch controller 50 will be explained in conjunction with FIGS. 2 and 3. When the external power voltage VEXT is turned on, the PMOS transistor P13 and the NMOS transistor N12 voltage-divide the external power voltage VEXT, and establish a predetermined reference voltage.

The PMOS transistor P14 and the NMOS transistor N13 invert the reference voltage. The inverted reference voltage is converted into the switching control signal S1 by being delayed by the inverters IV1 and IV2.

During a specific power potential period of an initial operation, the switching control signal S1 goes to a low level when the external power voltage VEXT is lower than a predetermined voltage level. At this time, if the PMOS transistor P12 of the switch circuit 60 is turned on, the external power voltage VEXT is connected to the internal power voltage QVINT supply line 70. And then, a high voltage driven from the external power voltage VEXT is transferred to the internal power voltage QVINT supply line 70. The first reference circuit 10 makes use of the high voltage as a power source. Then, when the external power voltage VEXT is higher than the predetermined voltage after the specific power potential period, the control signal S1 goes to a high level. At this time, the PMOS transistor P12 of the switch circuit 60 is turned off, and thereby the external power voltage VEXT is disconnected from the internal power voltage QVINT. Thus, only the internal power voltage QVINT is applied to the first reference circuit 10.

Here, the switch controller 50 operates the switch circuit 60 to connect the external power voltage VEXT to the internal power voltage QVINT supply line 70 in a specific potential range, e.g., less than 2 V, and to cut off the connection in a higher potential range than the specific potential range.

Further, the switching control signal S1 of the switch controller 50 may have the operational characteristics of an hysteresis loop while it is being conductive to control the switch circuit 60.

For instance, the switch controller 50 operates the switch circuit 60 to disconnect the external power voltage VEXT from the internal power voltage QVINT supply line 70 in a specific potential range higher than 2 V, and to connect the external power voltage VEXT to the internal power voltage QVINT supply line 70 in a potential range lower than 1 V.

In other words, the connection of the external power voltage terminal VEXT and the internal power voltage QVINT supply line 70 is cut off in a potential range higher than 2 V when a power source is being supplied to a chip. When the power source is not being supplied to the chip, the external power voltage terminal VEXT is connected to the internal power voltage QVINT supply line 70 in a potential range lower than 1 V.

Figure 4:
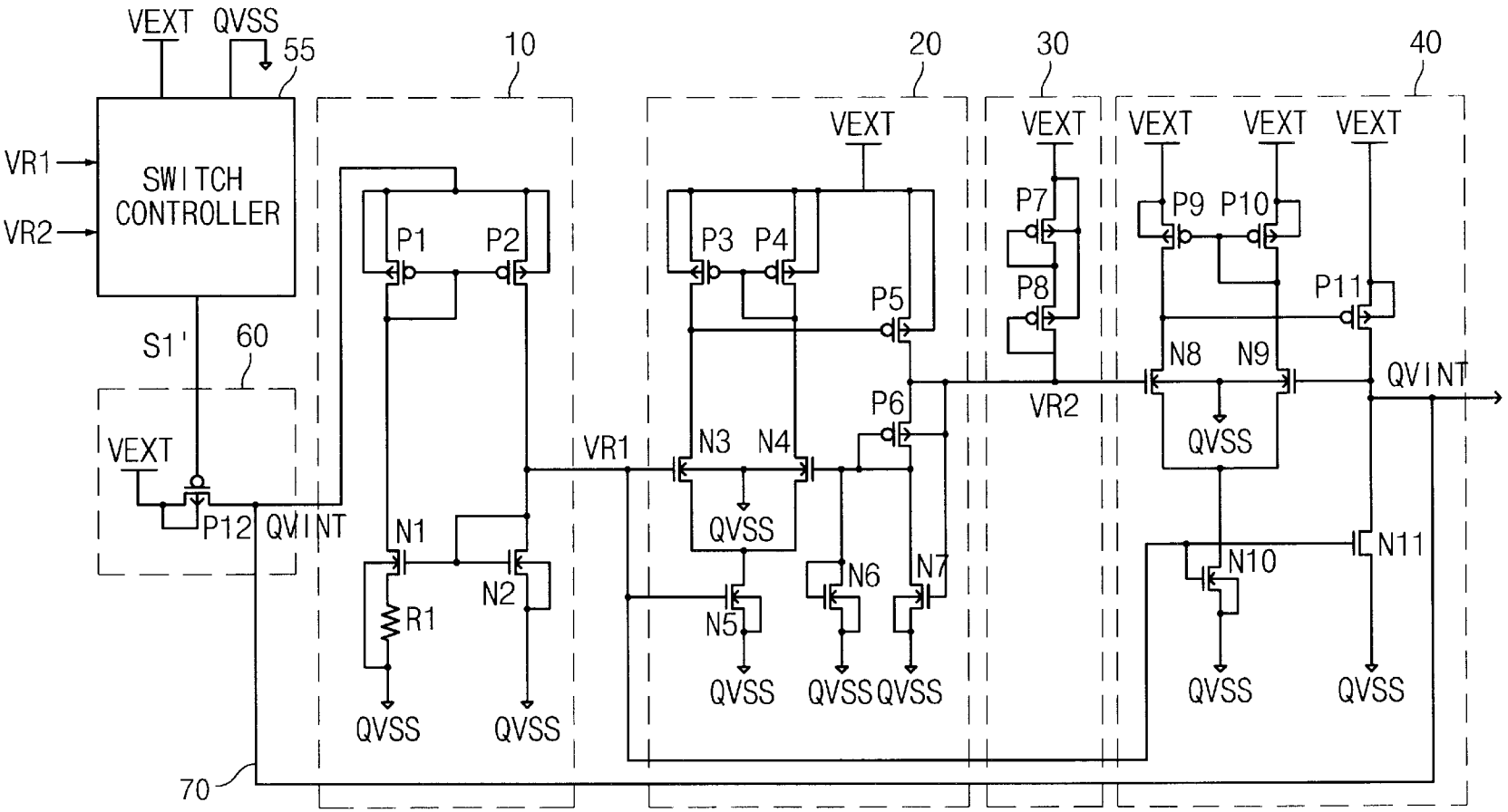
FIG. 4 is a circuit diagram showing an internal power voltage generator according to another embodiment of the present invention.

FIG. 4 shows another embodiment of an internal power voltage generator according to the present invention.

A switch controller 55 generates a control signal S1' in response to the first and second reference voltages VR1 and VR2, which are each provided from the first and second reference circuits 10 and 20. Here, the circuit constructions except the switch controller 55 are identical to those shown in FIG. 3.

Figure 5:
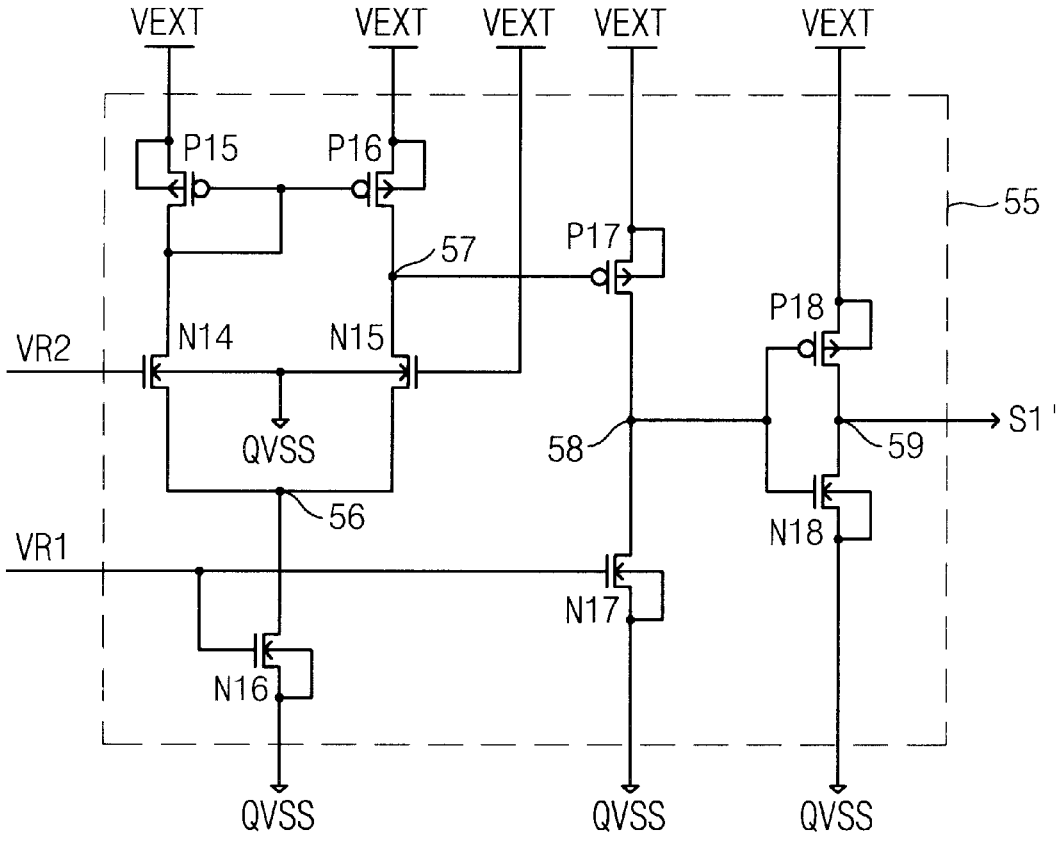
FIG. 5 is a circuit diagram showing a switch controller employed in the internal power voltage generator shown in FIG. 4.

FIG. 5 shows a detailed circuit construction of the switch controller 55 shown in FIG. 4.

Referring to FIG. 5, the switch controller 55 is comprised of PMOS transistors P15~P18 and NMOS transistors N14~N18. The PMOS and NMOS transistors P15~P16 and N14~N16 form a differential amplifier. The PMOS transistors P15 and P16 respectively have source nodes connected to the external power voltage terminal VEXT, gates coupled to a drain node of the PMOS transistor P15 in common, and bulk regions connected to the external power voltage terminal VEXT. The NMOS transistor N14 whose gate is coupled to the second reference voltage VR2 is connected between the common drain node of the PMOS transistors P15 and P16 and a node 56. The NMOS transistor N15 whose gate is coupled to the external power voltage terminal VEXT is connected between a node (an output of the differential amplifier) and the node 56. Bulk regions of the NMOS transistors N14 and N15 are connected to the ground voltage terminal QVSS in common the NMOS transistor N16 whose gate is coupled to the first reference circuit VR1 is connected between the node 56 and the ground voltage terminal QVSS. The PMOS transistor P17 whose gate is coupled to the node 57 is connected between the external power voltage terminal VEXT and a node 58, and the NMOS transistor N17 whose gate is coupled to the first reference voltage VR1 is connected between the node 58 and the ground voltage terminal QVSS. The PMOS and NMOS transistor P18 and N18 are connected between the external power voltage terminal VEXT and the ground voltage terminal QVSS and performs as an inverter. Gates of the PMOS and NMOS transistors P18 and N18 are coupled to the node 58 disposed between the PMOS and NMOS transistors P17 and N17. The switching control signal S1' is generated from an output terminal 59 (or a common drain node) disposed between the PMOS and NMOS transistors P18 and N18.

The switch controller 55 compares the external power voltage VEXT with the second reference voltage VR2 by making use of the differential amplifier of a current mirror type enabled by the first reference voltage VR1, and generates the switching signal S1' by inverting the compared out signal through the inverter formed of the PMOS and NMOS transistors P18 and N18.

In other words, in a power potential range of initial operation, the control signal S1 is set on a low level if the external power voltage VEXT is lower than the second reference voltage VR2. At this time, the PMOS transistor P12 of the switch circuit 60 is turned on, so that the external power voltage terminal VEXT is connected to the internal power voltage QVINT supply line 70. And then a high voltage of VEXT is provided to the supply line 70 which is connected to source nodes of the PMOS transistors, P1 and P2.

Afterwards, when the external power voltage VEXT is higher than the second reference voltage VR2 after a specific power potential range, the control signal S1' goes to a high level. At this time, the PMOS transistor P12 of the switch circuit 60 is turned off, so that the external power voltage terminal VEXT is disconnected from the supply line 70 of the internal power voltage QVINT. Thus, only the internal power voltage QVINT is applied to the first reference circuit 10.

Here, the switch controller 55 may be utilized as a general power-up circuit serving to initialize the chip. Or, it is possible to use the switch controller apart from the power-up circuit, or to employ it as a circuit having a similar function for another object.

The first reference circuit 10 in the present invention is operable with the external power voltage when the external power voltage terminal VEXT is in a specific potential range connected to the internal power voltage QVINT supply line 70 through the switch circuit 60, but is driven only with the internal power voltage QVINT when the connection is cut off in the other potential ranges.

Since the internal power voltage QVINT is less changeable than the external power voltage VEXT, the first reference voltage VR1 can be stably established therein. The stabilized voltage level of the first reference voltage VR1 generates stable voltage levels for the second reference voltage VR2 and the internal power voltage QVINT.

Figure 6:
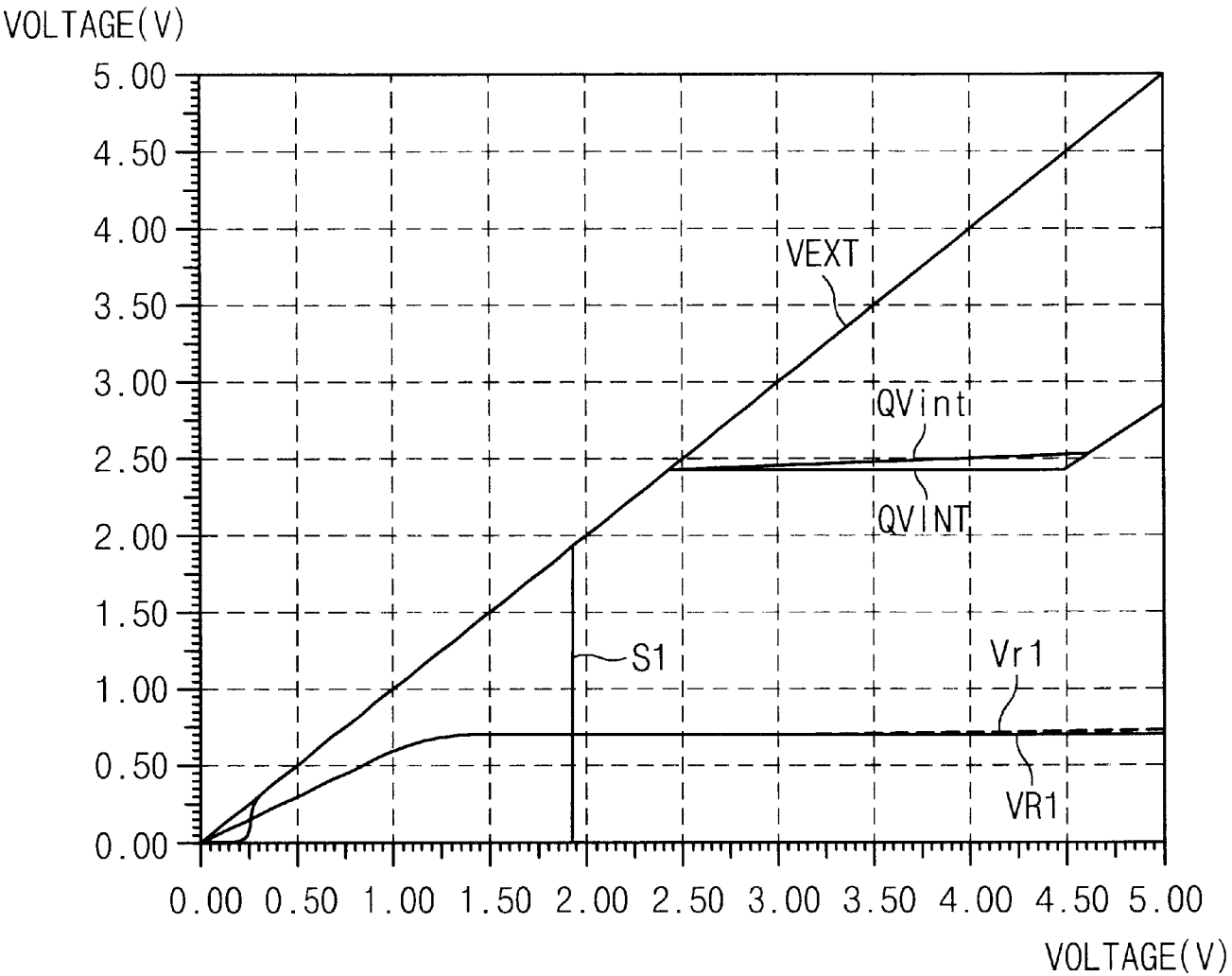
FIGS. 6 through 8 are graphic diagrams showing operational characteristics evaluated by a simulation process for the internal power voltage generator of the present invention.
Figure 7:
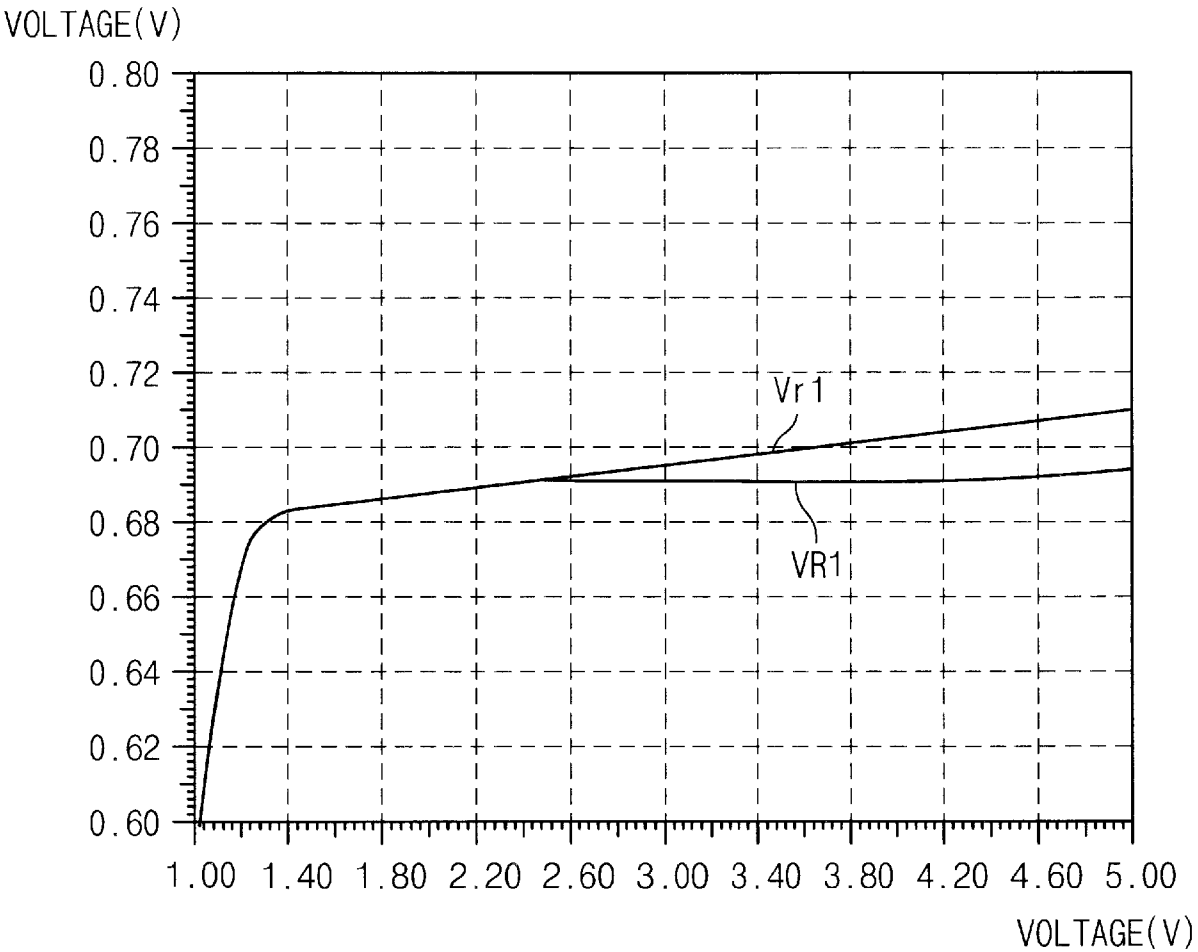
Figure 8:
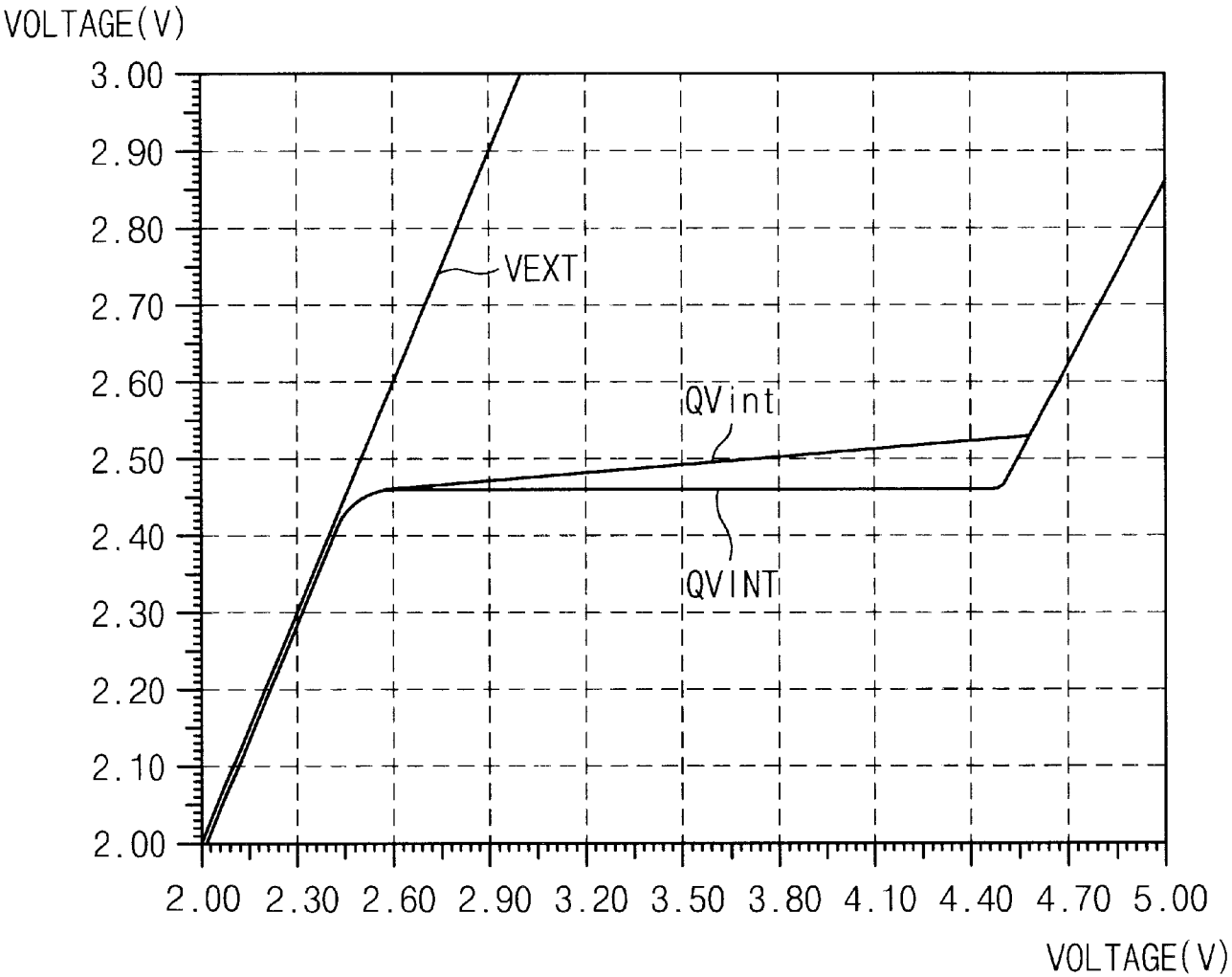

FIGS. 6–8 show operational characteristics of the internal power voltage generator according to the present invention. FIG. 6 shows all the features of voltage plots involved in the operation of generating the internal power voltage, including waveforms of the external power voltage VEXT, the internal power voltage QVINT and the conventional power voltage QVint, the first reference voltage VR1 and the conventional one Vr1, and the switching control signal S1. FIG. 7 illustrates close-up plots of the first reference voltage VR1 and the conventional reference voltage Vr1, and FIG. 8 illustrates close-up plots of the internal power voltage QVINT of the conventional power voltage QVint.

Referring to FIG. 6, the switching control signal S1 (or S1') of the switch controller 50 (or 55) is established at about 2 V to control a connection between the external power voltage terminal VEXT and the supply line 70 of the internal power voltage QVINT.

Referring to FIG. 7, the conventional reference voltage Vr1 increases in accordance with an increase of the external power voltage VEXT while the present reference voltage VR1 is constant in an operation period of forming the reference voltage with the internal power voltage QVINT.

Referring to FIG. 8, the conventional internal power voltage QVint is increased according as the increment of the external power voltage VEXT is increased. However, in the present invention, even though the external power voltage VEXT is increased, the internal power voltage QVINT is constant in the potential period of forming the reference voltage with the internal power voltage QVINT.

Consequently, it is possible to generate the stable internal power voltage QVINT by using the constant reference voltage VR1 as the reference voltage.

Figure 9:
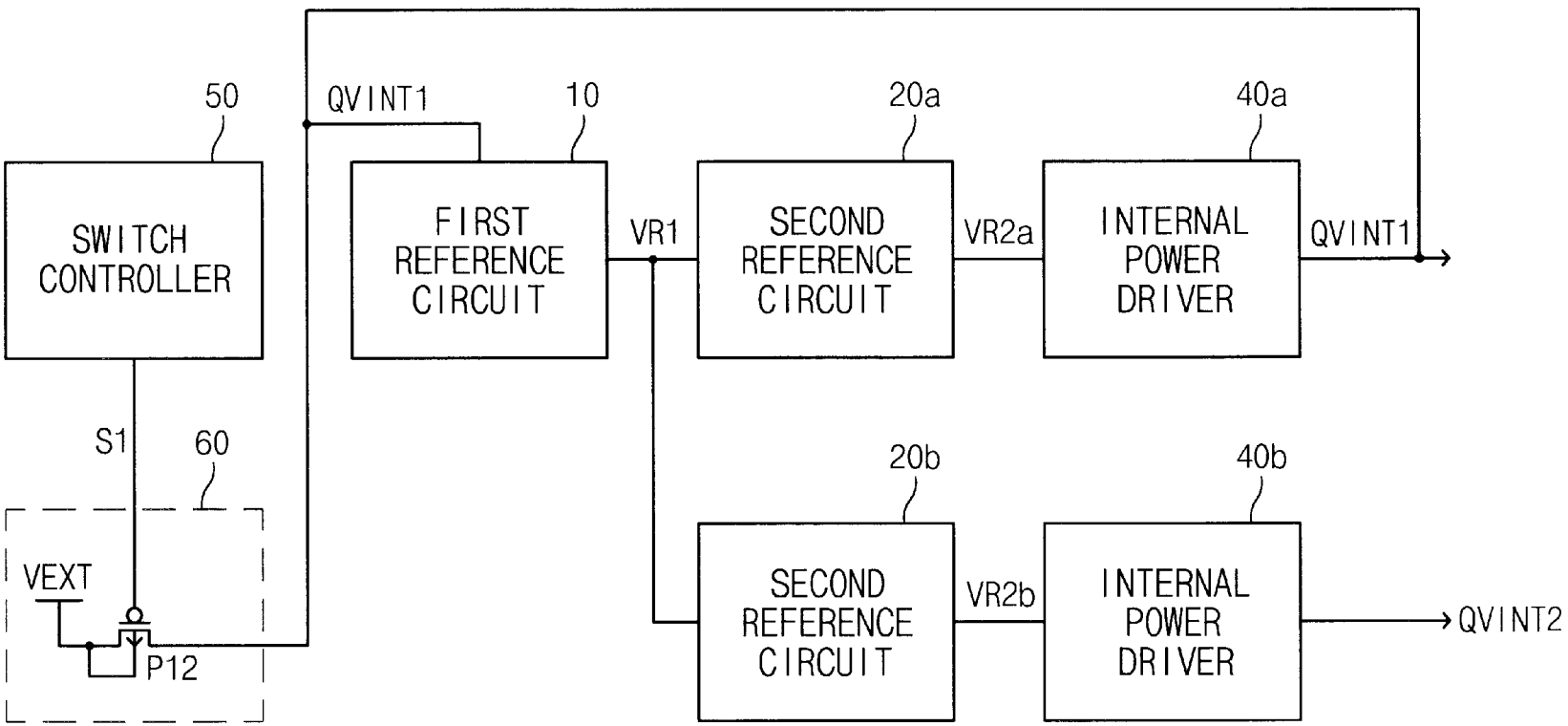
FIG. 9 is a block diagram showing an internal power voltage generator according to still another embodiment of the present invention.

Meanwhile, the present invention can add additional elements for the second reference circuit and the internal power driver, including the drive condition of the reference circuit 10, as shown in FIG. 9. The internal power voltage generator of FIG. 9 includes pairs of the second reference circuits and the internal power drivers 20*a*/20*b* and 40*a*/40*b*. The second reference circuits 20*a* and 20*b* generate a pair of the second reference voltages VR2*a* and VR2*b* and the internal power drivers 40*a* and 40*b* generate a pair of internal power voltages, QVINT1 and QVINT2, respectively. The internal power voltage QVINT1 is connected to the first reference circuit 10 and the external power voltage terminal VEXT through the switch circuit 60.

As described above, the internal power voltage generator according to the present invention can achieve stable operation of a semiconductor device by generating the stable internal power voltage, resulting in improving the production yield.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An internal power voltage generator for use with an integrated circuit having internal circuits, an external power voltage terminal, and an internal power voltage supply line, said internal power voltage generator generating an internal power voltage and comprising:

switching control means for connecting the external power voltage terminal to the internal power voltage supply line when an external power voltage of said external power voltage terminal is in an operation power potential range, and for cutting off the connection between the external power voltage terminal and the internal power voltage supply line and supplying a feedback internal power voltage to said internal power voltage supply line if the external power voltage reaches a predetermined potential level that is outside said operation power potential range;

a first reference circuit for generating a predetermined first reference voltage by making use of a voltage output from said switching control means;

a second reference circuit for generating a second reference voltage by amplifying the first reference voltage supplied from the first reference circuit; and an internal power driver for generating the internal power voltage with the second reference voltage supplied from the second reference circuit, and for driving the internal circuits with the internal power voltage, said internal power driver providing the internal power voltage to said internal power voltage supply line as the feedback internal power voltage.

2. The internal power voltage generator of claim 1, wherein the switch control means comprises:

a switch controller for providing a control signal to selectively connect the external power voltage terminal to the internal power voltage supply line in a specific potential range between ground voltage and the external power voltage; and a switch for connecting the external power voltage terminal to the internal power voltage supply line in response to the control signal from the switch controller.

3. The internal power voltage generator of claim 2, wherein the switch controller comprises:

a resistor element for reducing the voltage level from the external power voltage terminal;

a diode element for generating a predetermined reference voltage through the resistor element in accordance with the reduced voltage from the external power voltage terminal;

an inverter unit for converting the reference voltage generated at the diode element; and a delay unit for delaying the output of the inverter unit and providing the control signal.

4. The internal power voltage generator of claim 2, wherein the switch controller comprises:

a differential amplifying unit of a current mirror type for comparing the second reference voltage with the external power voltage from the external power voltage terminal;

a plurality of switch elements for enabling an operation of the differential amplifying unit in response to an input of the first reference voltage; and an inverter unit for converting an output of the differential amplifying unit and providing the control signal.

5. The internal power voltage generator of claim 2, wherein the switch is formed of a P-channel metal oxide semiconductor transistor that is a switch element for selectively connecting the external power voltage terminal to the internal power voltage supply line in response to the control signal.

6. An internal power voltage generating unit for use with an integrated circuit having internal circuits, an external power voltage terminal, and an internal power voltage supply line, said internal power voltage generating unit generating an internal power voltage and comprising:

a first reference circuit receiving input from said internal power voltage supply line for generating a predetermined first reference voltage;

a second reference circuit for generating a second reference voltage by amplifying the first reference voltage supplied from the first reference circuit;

an internal power driver for generating the internal power voltage with the second reference voltage supplied from the second reference circuit, and for driving the internal circuits with the internal power voltage, said internal power driver providing the internal power voltage to said internal power voltage supply line as a feedback internal power voltage;

a switch controller for generating a reference voltage from the external power voltage which is converted into a control signal to selectively connect the external power voltage terminal to the internal power voltage supply line when an external power voltage from said external power voltage terminal is in a specific potential range; and a switch circuit for connecting the external power voltage terminal to the internal power voltage supply line to output said external power voltage to said first reference circuit in response to the control signal from the switch controller, and for cutting off the connection between the external power voltage terminal and the internal power voltage supply line to output the feedback internal power voltage to said first reference circuit when the external power voltage reaches a predetermined potential level that is outside said specific potential range.

7. The internal power voltage generating unit of claim 6, wherein the switch controller comprises:

a resistor element for reducing the voltage level from the external power voltage terminal;

a diode element for generating a predetermined reference voltage through the resistor element in accordance with the reduced voltage from the external power voltage terminal;

an inverter unit for converting the reference voltage generated at the diode element; and a delay unit for delaying the output of the inverter unit and providing the control signal.

8. The internal power voltage generating unit of claim 6, wherein the switch controller comprises:

a differential amplifying unit of a current mirror type for comparing the second reference voltage with the external power voltage from the external power voltage terminal;

a plurality of switch elements for enabling an operation of the differential amplifying unit in response to an input of the first reference voltage; and an inverter unit for converting an output of the differential amplifying unit and providing the control signal.

9. The internal power voltage generating unit of claim 6, wherein the switch circuit is formed of a P-channel metal oxide semiconductor transistor that is a switch element for selectively connecting the external power voltage terminal to the internal power voltage supply line in response to the control signal.

* * * * *